United States Patent [19]

Kruger

[11] 4,390,218

[45] Jun. 28, 1983

[54] COAXIAL TRANSMISSION LINE CONNECTOR

[76] Inventor: Jack L. Kruger, P.O. Box 215, Goffstown, N.H. 03045

[21] Appl. No.: 197,474

[22] Filed: Oct. 16, 1980

Related U.S. Application Data

[63] Continuation-in-part of Ser. No. 19,325, Mar. 12, 1979, abandoned.

[51] Int. Cl.[3] ..... H01R 11/02

[52] U.S. Cl. ..... 339/9 E; 339/112 R; 339/177 R

[58] Field of Search ..... 339/9 R, 9 A, 9 E, 177 R, 339/177 E, 256 R, 256 S, 278 C, 112 R

[56] References Cited

U.S. PATENT DOCUMENTS

| | | | |
|---|---|---|---|
| 3,319,214 | 5/1967 | Sewell | 339/177 R |
| 3,432,779 | 3/1969 | Sewell | 339/177 R |
| 3,818,421 | 6/1974 | Kruger | 339/177 R |

FOREIGN PATENT DOCUMENTS

| | | | |
|---|---|---|---|
| 128148 | 6/1948 | Australia | 339/9 R |

OTHER PUBLICATIONS

Marks Mech. Engineers' Handbook-6th Edition, pp. 4-94.

*Primary Examiner*—Joseph H. McGlynn
*Attorney, Agent, or Firm*—C. Yardley Chittick

[57] ABSTRACT

The construction of an expansion joint for use in the inner power conductor of a coaxial transmission line whereby the heat generated in the line may flow through the joints from the hotter areas to the cooler areas and conventional heat sinks with such ease and rapidity that there will be no destructive temperature buildup at any of the joints in the line. This is accomplished in major part by the introduction within each joint of a short section of metallic tubing of good heat conductivity that is in contact with both parts of the joint in heat transmitting relation. The tubing in combination with the novel joint construction greatly increases the rate of heat flow from the hotter part of the joint to the less hot part. The tubing is preferably fixed to one part of the joint and in sliding engagement with the other but it may be in sliding engagement with both parts.

12 Claims, 4 Drawing Figures

COAXIAL TRANSMISSION LINE CONNECTOR

BACKGROUND OF THE INVENTION

This application is a continuation-in-part of the application of Jack L. Kruger for Coaxial Transmission Line Connector, Ser. No. 19,325 filed Mar. 12, 1979, now abandoned.

In a coaxial power transmission line of the type commonly in use on radio and television antennas, the outer supporting tube is an integral unit comprised of a succession of tubular lengths (each usually 20 feet) having flanged ends bolted together. This outer tube expands and contracts over its entire length in accord with temperatures to which it is subjected.

The inner power tube is comprised of a series of twenty foot lengths, each length being supported by an insulating annular element the outer part of which is bolted between the flanges of the outer supporting tube. Since the extent of the expansion and contraction of the two tubes is not equal, it is necessary that the inner tubes be connected by sliding joints. The connection must be electrically correct so that sliding movement of the joint can take place without loss of electrical efficiency.

The prior art shows a number of different sliding joint constructions, some of which are currently in use. These constructions have been designed with primary attention directed to the electrical transmission aspect.

The radio and TV stations have over the years gradually increased their power output to widen the station's coverage. This increase in power has, of course, increased the operating temperature of the inner power tube. The customary means for dissipating this heat is by radiation to the outer supporting tube across the gas-filled gap and by conduction along the power tube to the heat sinks of which there are usually two, one near the upper end of the line and the other near the lower end.

Unless the heat can flow substantially unimpeded from the hotter intermediate portions of the inner tube to the heat sinks, there will be a temperature build-up, particularly at the expansion joints, under conditions of high continuous power to cause one or more joints to burn out. This requires closing of the antenna and extensive costly repairs.

Accordingly, the present available means for achieving heat dissipation requires that the power output of existing stations be strictly limited if damage is to be avoided.

SUMMARY OF INVENTION

The constructions of the expansion joints found in the present-day coaxial power lines are in general adequate from an electrical transmission standpoint. From a heat transmission standpoint, however, they are inadequate to meet the power loads the stations wish to apply.

The present invention includes a totally new expansion joint which is equal or superior electrically to joints now in use and far superior in its heat transmitting capability. The new result is achieved by substantially reducing the volume of the copper-based parts that engage each other to provide electrical continuity and then adding a heat bypass preferably in the form of a thin-walled metal tube of high thermal conductivity that straddles the joint on the inside of the tube. It will be understood however that the wall of the bypass may be of any thickness so long as the conductivity of the bypass is always substantially greater than the conductivity of the connector parts.

Tests have been made on expansion joints of the types now in general use in which heat at a controlled temperature was applied to a power tube a fixed distance from the joint. The time required for the controlled heat to flow along the fixed length of tube, then through the joint and on to a determined position on the next connected tube with the temperature rising to a selected temperature was measured. The time required for this measured heat flow through one joint now in use was 15 minutes, 56 seconds; in another joint now in use the time was 14 minutes, 30 seconds. In the construction of this invention the time was 9 minutes, 9 seconds.

These tests indicated clearly why the use of the joint of this invention will permit the use of increased power without danger of burn-outs.

DESCRIPTION OF A PREFERRED EMBODIMENT

The drawings referred to in detail hereinafter are drawn for clarity to approximately twice the size of the actual connector used in the power tube of a coaxial transmission line in which the outer tube is 6 inches in diameter. Once the principles of the invention are understood, the required dimensions for different sized transmission lines may be readily calculated and applied to the construction.

Figure 1:
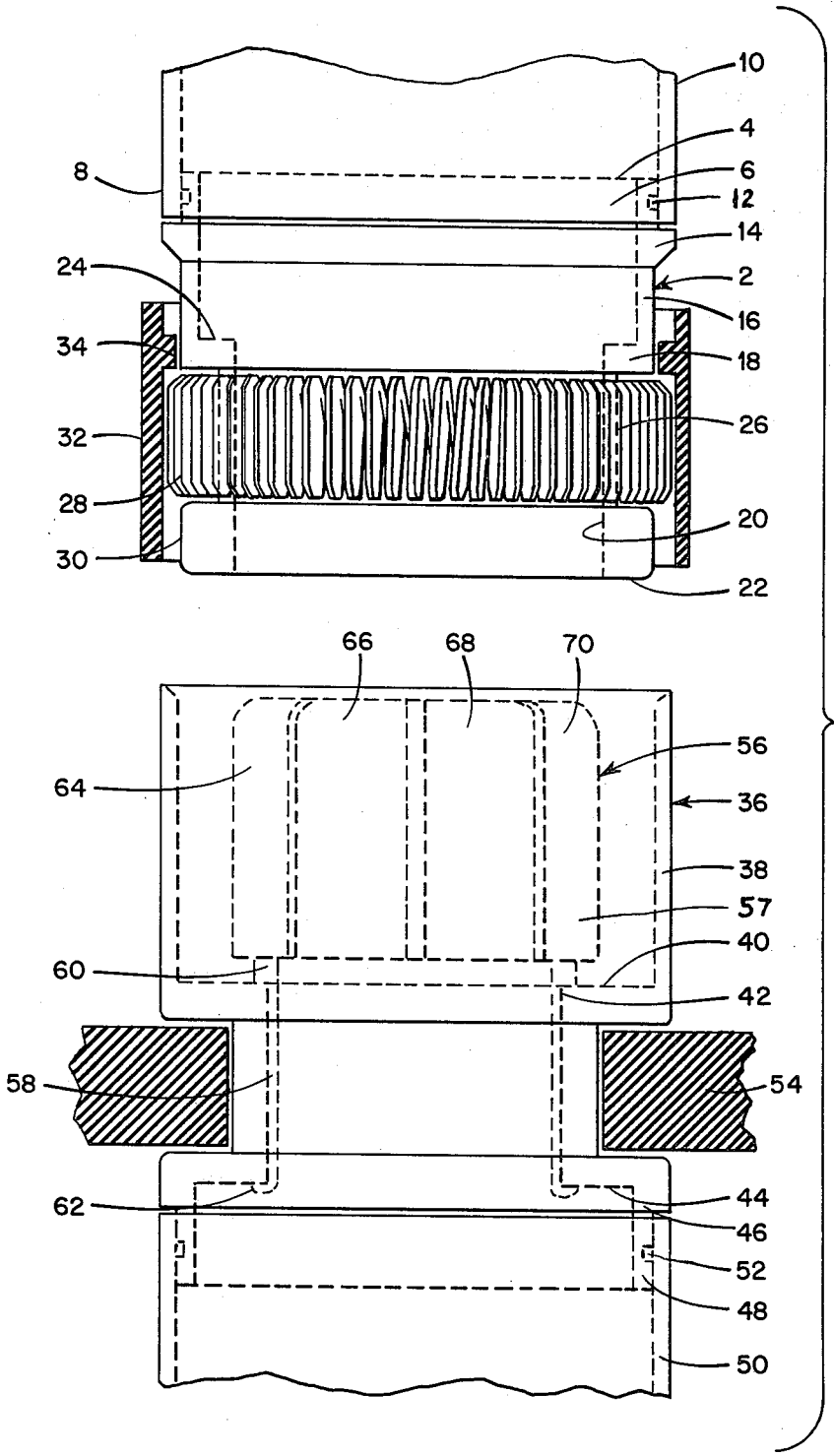
FIG. 1 is a side elevation of the connector with the parts disengaged.

Referring first to FIG. 1, the connector is shown in disengaged condition. The upper or first part of the connector is indicated generally at 2. It is tubular in form with its upper end at 4. The upper portion 6 is sized to receive in snug fitting relation the lower end 8 of a conventional 20 foot copper power tube 10. Tube 10 is soldered to portion 6 at 12 through the use of silver solder.

A shoulder 14 acts as a stop against which the end of tube 10 rests. The wall of part 2 extends downwardly as at 16 below shoulder 14 for a short distance with the same diameter and wall thickness as the portion 6. The wall then becomes substantially thicker as at 18 with the same outside diameter but with a reduced interior diameter to provide the cylindrical interior surface 20 which extends to the lower end 22 of part 2.

Intermediate between shoulder 24 and lower end 22 is a circumferential groove 26 in which is located a resilient electrical conductor 28, preferably in the form of a wristband spring made of silver plated beryllium copper. The spring is sized to press tightly against the wall of groove 26 and to extend radially outward beyond the exterior cylindrical surface 30 of part 2.

A sleeve 32 of electrical insulating material such as TEFLON surrounds spring 28. Sleeve 32 has an interior flange 34 in slidable relation to wall 16. Movement of sleeve 32 is limited upwardly by engagement of flange 34 with flange 14 and downwardly by engagement of flange 34 with spring 28.

The second part of the connector is generally referred to at 36. It is comprised of a relatively thin walled cylindrical section 38 whose interior wall is sized to fit loosely about wall 30 of the first part 2 and within sleeve 32. Section 38 terminates at shoulder 40 which extends inwardly to interior cylindrical wall 42. Wall 42 ends at lower shoulder 44 below which is a short section 46 of the same outer diameter as section 38.

Part 36 terminates in a short section 48 sized to receive the upper end of power tube 50 to which it is silver soldered at 52.

Intermediate shoulders 40 and 44 is a circular groove in which is positioned an annular supporting insulator 54. The outer periphery of insulator 54 (not shown) is clamped in gas tight relation between the flanged ends of the outer supporting tube (not shown) in the manner now in common use. It will be understood by those familiar with this art that each section of the inner power tube such as tubes 10 and 50 is supported at its upper end when assembly is complete by annular insulators or equivalent structure such as insulator 54.

A third part comprising a caloric or heat bypass is then positioned within the second part 36. This bypass element indicated generally at 56 is preferably made of a metal having a high coefficient of heat conductivity. Its lower end is in the form of a thin tube 58 fitting tightly within the interior wall 42 of second part 36. A shoulder 60 rests on shoulder 40 so that tube 58 can be secured by crimping the lower end 62 around the inner edge of shoulder 44.

Figure 3:
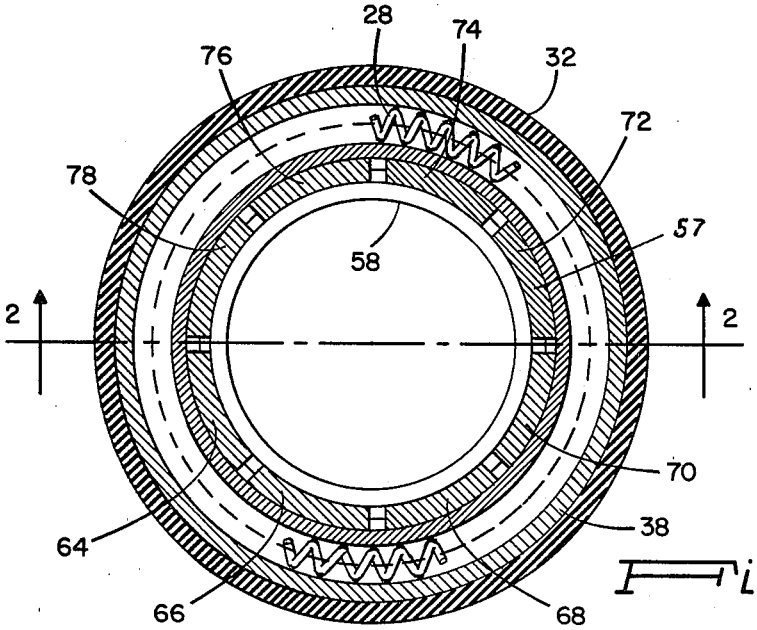
FIG. 3 is a horizontal section taken on the line 3—3 of FIG. 2.

The upper part of bypass 56 is in the form of a cylindrical wall 57 sized to make tight surface engagement with the interior cylindrical surface 20 of the first part 2 when the elements are placed in telescoped relation. In order to facilitate the entry of wall 57 into end 22, the wall is slotted to provide a plurality of flexible fingers 64, 66, 68, 70, 72, 74, 76, and 78 (see FIG. 3). The fingers whose numbers may be varied are chamfered at their upper ends so as to enter readily within the wall 20 of the lower section 22 of the first part 2.

The reduction in the exterior surface area of wall 57 by slotting it to create the flexible fingers is so small as to have substantially no effect on heat flow from end 22 to wall 57. The wall 57 may therefore be considered as being in continuous surface engagement with surface 20 when the elements are joined, whether or not it is slotted to create fingers.

In assembling a coaxial transmission line, the inner and outer tubes are progressively assembled by simultaneously lowering the inner and outer tubes of each section so that their lower ends engage the upper ends of the previously assembled section therebelow.

Figure 2:
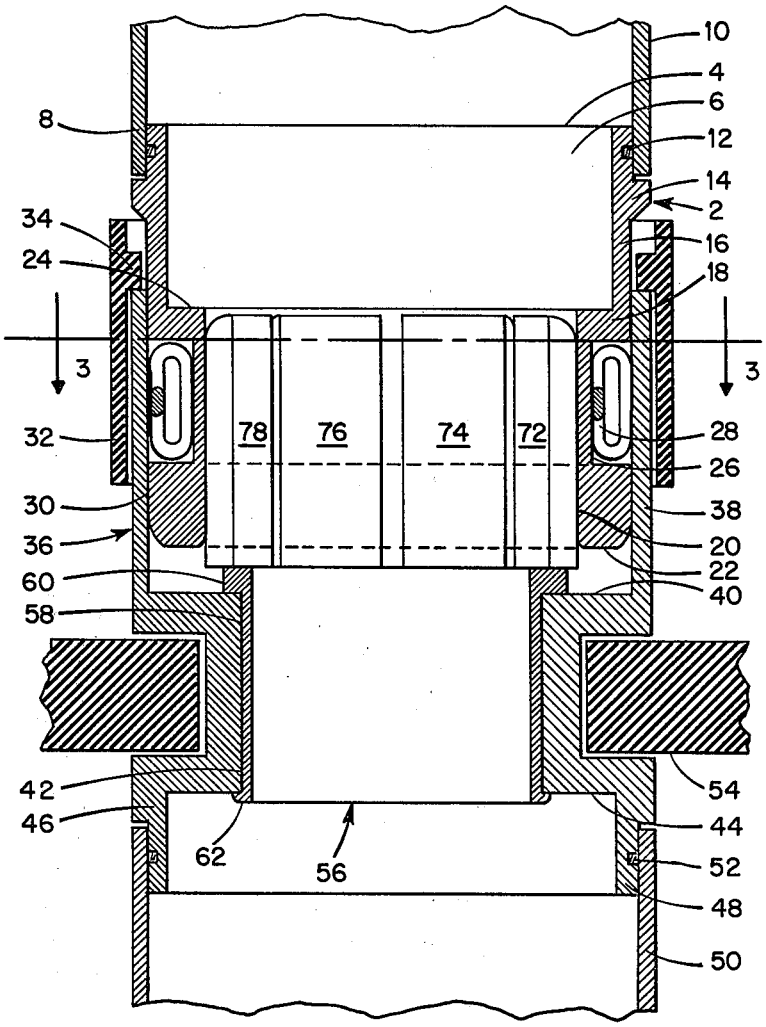
FIG. 2 is a vertical section taken on line 2—2 of FIG. 3 with the parts in full engagement.

Thus when tube 10 is lowered to meet with tube 50, the two parts of the connector engage and assume the position shown in FIG. 2. Section 38 telescopes with end 22 and makes proper electrical contact with spring 28. Sleeve 32 acts to positively keep spring 28 in groove 26 as the upper end of section 38 initially engages it and then slides thereover.

Figure 4:
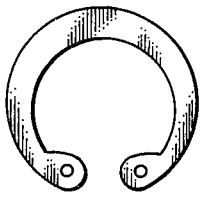
FIG. 4 shows in reduced scale an expander which may be used to press the fingers of the bypass outward with greater force.

The exterior surfaces of fingers 64, 66, 68, 70, 72, 74, 76, and 78 move into tight surface engagement with the interior cylindrical wall 20 of the upper first part 2 to provide excellent heat flow from first part 2 to second part 36. Additional outward pressure of the fingers against wall 20 may be obtained by using one or more conventional expanders such as shown in FIG. 4.

From the foregoing description of the connector, it will be understood that when tubes 10 and 50 expand or contract due to temperature changes, such relative motion is accommodated by the sliding of section 38 of second part 36 and fingers 64–78 of third part 56 relative to the end 22 and spring 28 of the first part 2 without change in the electrical capacity of the joint or the heat transmission ability from one part of the connector to the other through the metallic bypass.

The following additional features of the connector should be pointed out. If any galling occurs due to the repeated relative sliding movement of the two parts, the metallic particles so created will remain within the inner power tube thereby precluding any short circuiting from this source. The copper base connector parts themselves are of relatively small volume and weight thereby facilitating heat flow therethrough to the metallic bypass. Thus heavy applications of power which would cause burn-outs in equipment now in use due to inability of the joints to allow sufficiently rapid heat flow to the heat sinks, do not cause damage to power lines using this improved connector.

Since the flow of current is along the outer surface of the power line, the metallic bypass being on the interior of the joint has no adverse effect electrically. In addition electrolysis is avoided since there is no moisture or current within the power line.

The present connector eliminates entirely the use of brass which has thermal conductivity of only 68 BTU per square foot per foot per hour as compared with 212 BTU per square foot per foot per hour for tellurium copper, of which the connector parts are preferably made. The bypass is also preferably made of copper. Elimination of all brass parts speeds up heat flow and eliminates the silver plating required for proper electrical conductivity.

In summary, the invention provides a lightweight all copper base tubular power line connector of excellent electrical properties to which has been added an interior caloric bypass of such heat conductivity as to eliminate heat accumulations and resulting burn-outs.

The above description of the invention will suggest to others skilled in the art alternative arrangements which are intended to be within the scope of the following claims.

I claim:

1. An improved connector for reducing the resistance to heat flow through the expansion joint of the inner power conductor of a coaxial transmission line, said connector comprising a. first and second metallic cylindrical parts in which one end of said first part is positioned in telescoped relation within one end of said second part, b. means positioned between and engaging the said telescoped ends to provide electrical continuity between said parts and to permit relative axial movement of said parts, and c. a heat bypass member comprising a third cylindrical metallic part within the joint of said first and second parts, the exterior of one end of said third part being in continuous circular surface engagement with the circular interior surface of the end of said first part, and the exterior of the other end of said third part being in continuous circular surface engagement with the circular interior of a section of said second part adjacent the end of said first part.

2. The construction set forth in claim 1, said means being in the form of a resilient wristband spring, said spring being positioned in a circular groove in said first cylindrical part.

3. The construction set forth in claim 1, said second cylindrical part having a section of reduced diameter to receive therein a line supporting insulator.

4. The construction set forth in claim 1, the said one end of said third cylindrical part that is in surface engagement with the cylindrical interior surface of the end of said first part comprised of a plurality of flexible fingers.

5. The construction set forth in claim 1, the said one end of said bypass member being concentric with and spaced interiorly from the cylindrical end of said second cylindrical part, the spacing being such that the end of said first cylindrical part that is telescoped within the end of said second cylindrical part will have its interior cylindrical surface in good heat transmitting engagement with the exterior surface of said one end of said bypass member.

6. The construction set forth in claim 5, the said one end of said bypass member being slotted axially to provide a plurality of fingers which may flex inwardly under pressure applied thereto by the said interior cylindrical surface of said first cylindrical part.

7. The construction set forth in claim 1, said means being in the form of a resilient element pressing against the exterior of said first part and against the interior of said second part.

8. The construction set forth in claim 7, said third part being of copper and in tight engagement with the interior cylindrical surface of said second part and in sliding engagement with the interior cylindrical surface of said first part.

9. The construction set forth in claim 8, that portion of said third part that engages the interior surface of said first part being resilient and pressing outwardly against said first part.

10. The construction set forth in claim 7, said resilient element being in the form of a wristband spring made of beryllium copper and said first and second parts being made of tellurium copper.

11. The construction set forth in claim 10, said wristband spring residing in a circular groove in said first part and means for preventing dislodgement of said spring from said groove as the connector parts are being put together.

12. An expansion joint and heat bypass connector for use in the inner power conductor of a coaxial transmission line, said connector comprising a. a first cylindrical electrically conductive tube having a first cylindrical end part affixed thereto of less exterior diameter than said tube, b. a second cylindrical electrically conductive tube of the same diameter as said first tube and having a second cylindrical end part affixed thereto within which said first end part is positioned, c. a resilient electrically conductive element between and engaging the exterior of said first end part and the interior of said second end part and, d. a heat bypass member comprising a third cylindrical metallic part within the joint of said first and second parts, the exterior of one end of said third part being in continuous circular surface engagement with the circular interior surface of the end of said first part, and the exterior of the other end of said third part being in continuous circular surface engagement with the circular interior of a section of said second part adjacent the end of said first part.

* * * * *